US005933124A

United States Patent [19]

Sakimura

[11] Patent Number: 5,933,124

[45] Date of Patent: Aug. 3, 1999

[54] FOLDABLE HANDY REFLECTOR

[75] Inventor: Kenjiro Sakimura, Zushi, Japan

[73] Assignee: Sakimura Corporation, Kanagawa, Japan

[21] Appl. No.: 08/930,167

[22] PCT Filed: Feb. 27, 1997

[86] PCT No.: PCT/JP97/00587

§ 371 Date: Oct. 9, 1997

§ 102(e) Date: Oct. 9, 1997

[87] PCT Pub. No.: WO98/38695

PCT Pub. Date: Sep. 3, 1998

[51] Int. Cl.[6] ..... H01Q 15/20

[52] U.S. Cl. ..... 343/915; 343/912; 343/916

[58] Field of Search ..... 343/915, 912, 343/916, 840; H01Q 15/14, 15/20

[56] References Cited

U.S. PATENT DOCUMENTS 4,030,103 6/1977 Campbell ..... 343/915
5,446,474 8/1995 Wade et al. ..... 343/915
5,864,324 1/1999 Acker et al. ..... 343/915

FOREIGN PATENT DOCUMENTS 62-080412 5/1987 Japan .
62-140505 6/1987 Japan .

*Primary Examiner*—Hoanganh Le
*Assistant Examiner*—Kimnhung Nguyen
*Attorney, Agent, or Firm*—Price, Heneveld, Cooper, Dewitt & Litton

[57] ABSTRACT

A lateral reflector plate comprising two rotatable half plates mutually opposed through a rotation supporting shaft introduced therebetween, and a longitudinal plate comprising two half plates mutually opposed through the rotation supporting shaft introduced therebetween are vertical to each other, and a foldable bottom reflector plate comprising four quarter plates is intersected orthogonally with the lateral and longitudial reflector plates, and also the rotation supporting shaft is provided with an inclination supporting hole with an inclination of the detection design angle.

12 Claims, 17 Drawing Sheets

FOLDABLE HANDY REFLECTOR

TECHNICAL FIELD

The present invention relates to a handy reflector used for marine vessels and the like, and more particularly relates to a handy reflector used for small marine vessels, FRP (fiber-reinforced plastic) pleasure boats, and the like.

BACKGROUND ART

Small marine vessels and the like are provided with radar reflectors for preventing maritime disaster, and particularly, in congested sea areas, nighttime navigation, under poor weather conditions such as fog and so forth, it is the duty of such marine vessels to sail with radar reflectors mounted.

Regarding conventional radar reflectors, so-called all-directional corner reflectors capable of catching radar waves from all directions are used, such being comprised of eight triangular corner reflectors, each of these comprised of three orthogonal faces of metal plates.

However, since such all-directional corner reflectors are not capable of being folded, the corner reflector is stored in a state of the three faces of metal plates remaining in an orthogonal state, i.e., in a three-dimensional state.

As a result, a greater storage space is required therefore as compared to cases wherein the corner reflector is folded and stored, and also, care must be taken so as not to crush the metal plates.

Therefore, a foldable reflector (radar reflector) such as described below has been developed (See Japanese Unexamined Utility Model Publication No. 62-80412). That is to say, a radar reflector of a spherical outer form comprising: eight corner reflectors of which each corner is formed of three planes, wherein five main reflector plates are bound in a booklet-like manner, and sub-reflector plates which have an apex angle of 90° and which are foldable in two along the bisector of the apex angle are each provided between the respective five main reflector plates, and wherein the sub-reflector plates are positioned with the apex angle thereof at the ridge of each of the main reflector plates and are integrally fixed upon the central bisectors of the main reflector plates on both sides of the apex angle, and wherein the main reflector plates on both right and left sides are provided with mutually overlapping through holes at a position at 45° from the ridge and also a fastener is provided thereto so as to allow for overlapping adhesion at each of the outer planes, thus constructing a radar reflector which is assembled by opening the main reflector plates in a cross-like intersecting manner with the ridge serving as the axis.

As it can be understood from the form thereof, all-directional corner reflectors are limited regarding the angles of incidence and reflection of radar waves, and have approximately the same angle of reflection in both the horizontal and longitudinal directions with isosceles triangle corner reflectors.

Accordingly, the greatest angle of reflection at the width of approximately 40° (−3 dB half-voltage value) is 36° upwards when the triangle serving as the base (bottom reflector plate) is placed flat, so in the event that the reflector is to be mounted, the mounting thereof must be conducted such that the reflector plate is 36° upwards. This upwards angle is referred to as a detection design angle.

However, radar reflectors according to the conventional example are assembled, then strings are attached to the through holes in the main reflector plates, and the radar reflector is hung by means of fixing the strings to predetermined locations, and accordingly, in the event that the radar reflector is subjected to exterior force such as the wind, the reflector is displaced at random in up and down directions, forward and backward directions, right and left directions, and so forth, so that it is difficult to maintain the bottom reflector plate at the detection design angle. Consequently, radar waves cannot be caught and reflected effectively over a wide area.

The object of the present invention is to provide a foldable handy reflector which can be set at the detection design angle in a precise and yet easy manner.

DISCLOSURE OF INVENTION

The present invention comprises:

- a lateral reflector plate, further comprising two rotatable half plates mutually opposed through a rotation supporting shaft introduced therebetween,
- a longitudinal reflector plate, further comprising two half plates mutually opposed through the rotation supporting shaft introduced therebetween, wherein the lateral reflector plate and the longitudinal reflector plate are vertical to each other, and
- a foldable bottom reflector plate, further comprising four quarter plates, each of the four quarter plates intersected orthogonally with the lateral reflector plate and longitudinal reflector plate, forming eight corner reflectors.

Each of the four quarter plates of the bottom reflector plate is provided inbetween the mutually opposing longitudinal and lateral reflector plate, thereby ensuring that the neighboring half plates are intersecting orthogonally.

Three of the four quarter plates are each folded in two at folding portions, and both edges thereof are linked by means of hinges to the half plates of the longitudinal reflector plate and the lateral reflector plate.

The other quarter plate has one edge thereof linked by means of hinges to the half plate of one of the longitudinal reflector plate or the lateral reflector plate, and the other edge thereof is linked by linking means to the half plate of the other reflector plate.

At the center portion of this rotation supporting shaft is provided an inclination supporting hole with an inclination of a detection design angle as to the center axis of the rotation supporting shaft. A supporting member, such as a pole, for example, is inserted into the supporting hole, rotatably supporting the rotation supporting shaft.

When this pole is raised, the bottom reflector plate of the aforementioned reflector assumes the inclination of detection design angle as to a horizontal line orthogonally intersecting the center axis of the pole, and the rotation supporting shaft is rotatably supported. Thus, detection of radar waves can be conducted in all directions while maintaining the maximum reflection angle.

BEST MODE FOR CARRYING OUT THE INVENTION

Figure 1:
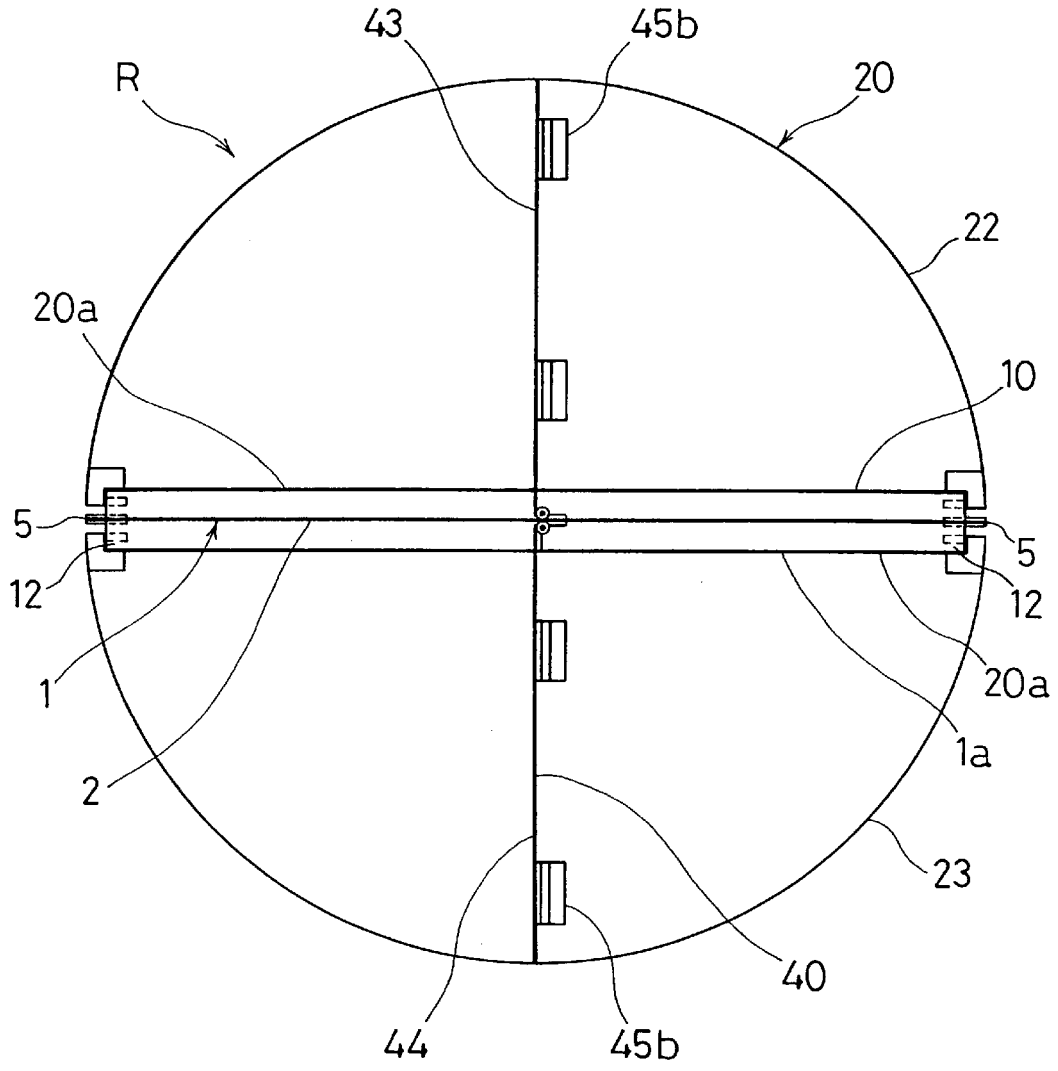
FIG. 1 is a frontal view illustrating the first embodiment of the present invention.
Figure 2:
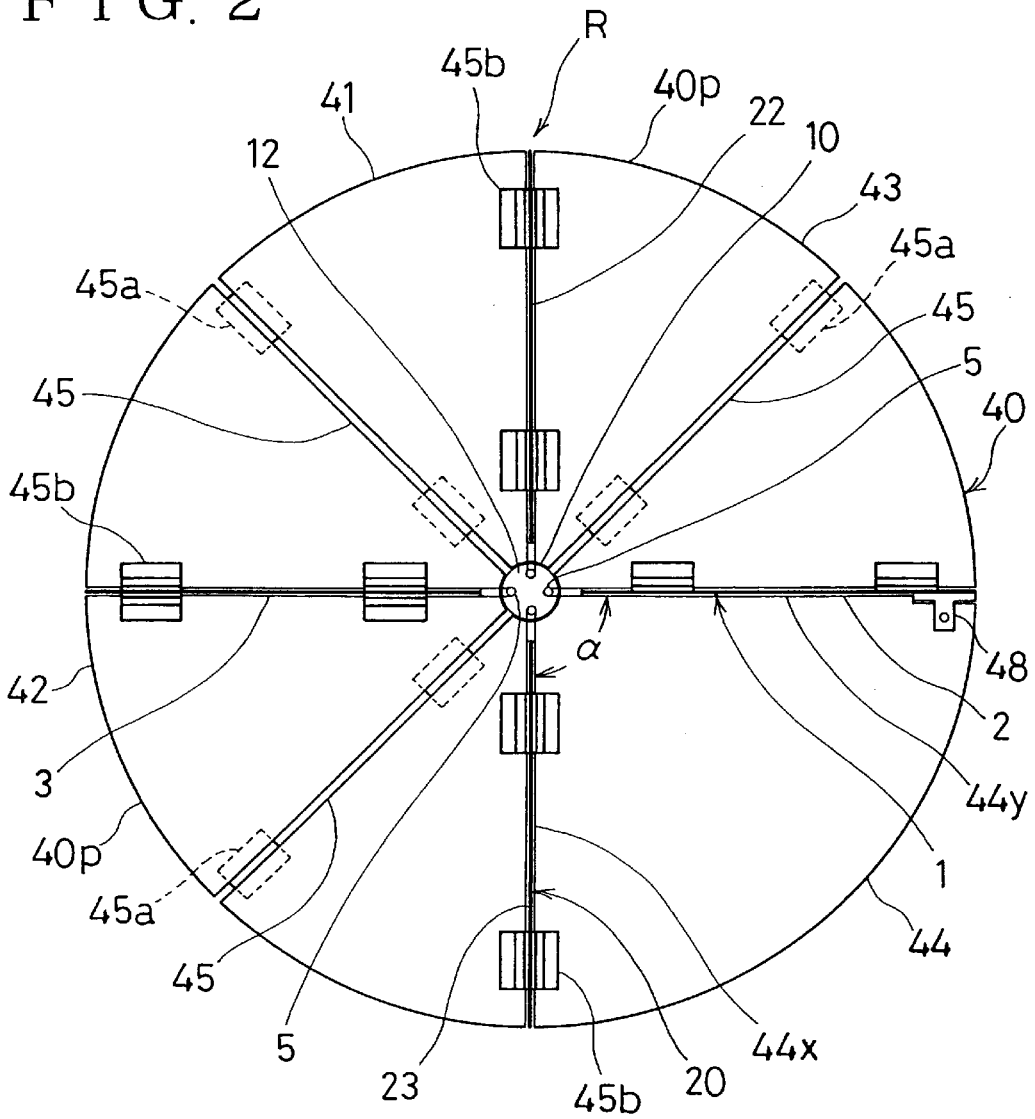
FIG. 2 is a side view illustrating the first embodiment of the present invention.
Figure 3:
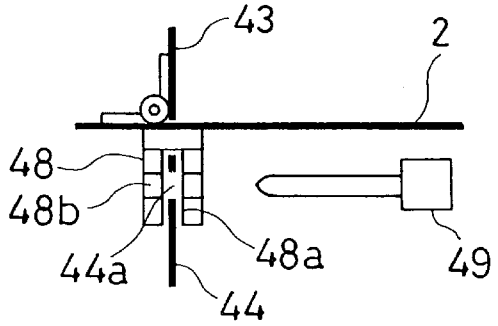
FIG. 3 is an enlarged side view of the principal components of FIG. 2.
Figure 4:
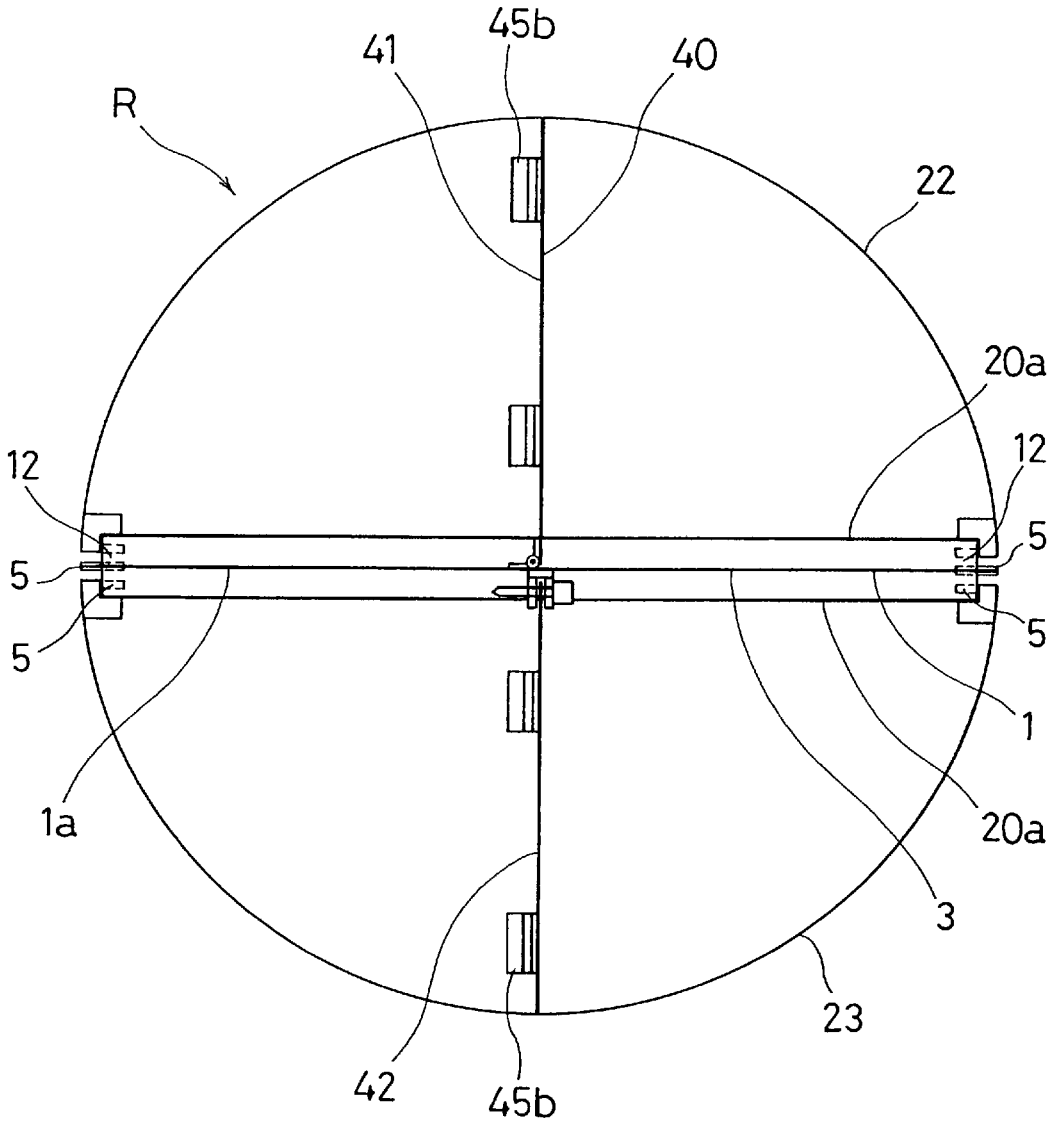
FIG. 4 is a rear view illustrating the first embodiment of the present invention.
Figure 5:
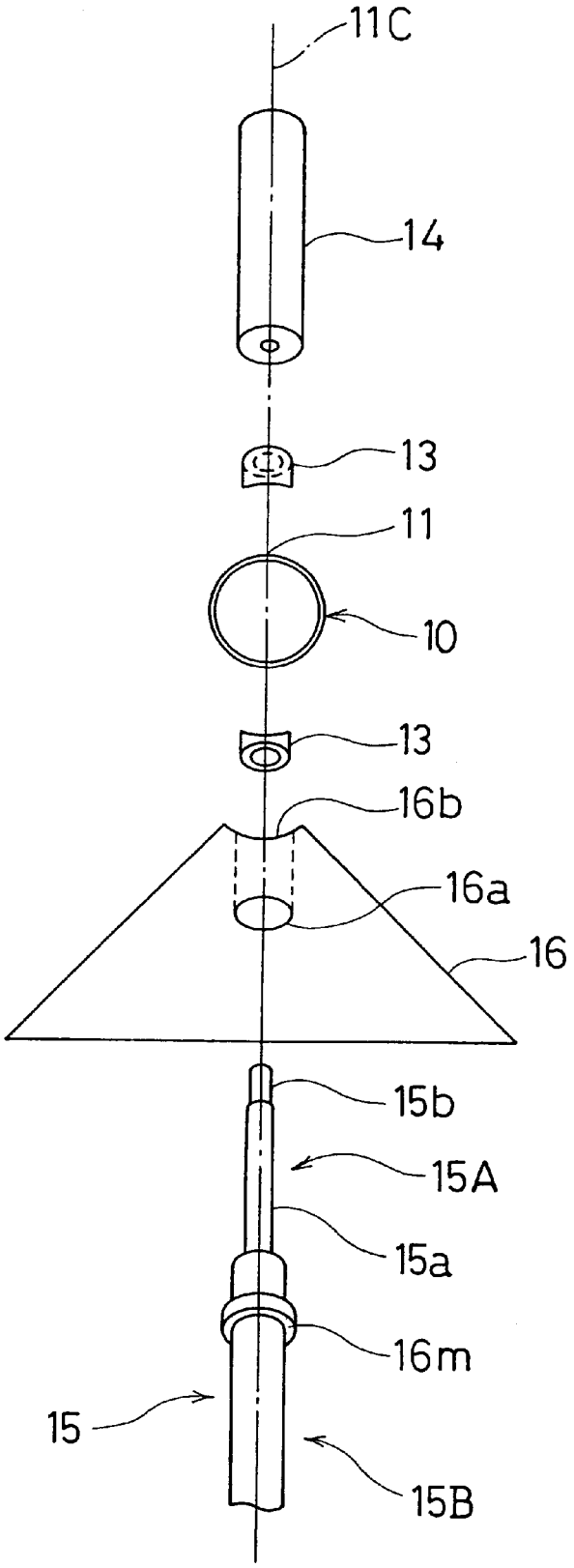
FIG. 5 is a perspective view illustrating a pole inserting member.
Figure 6:
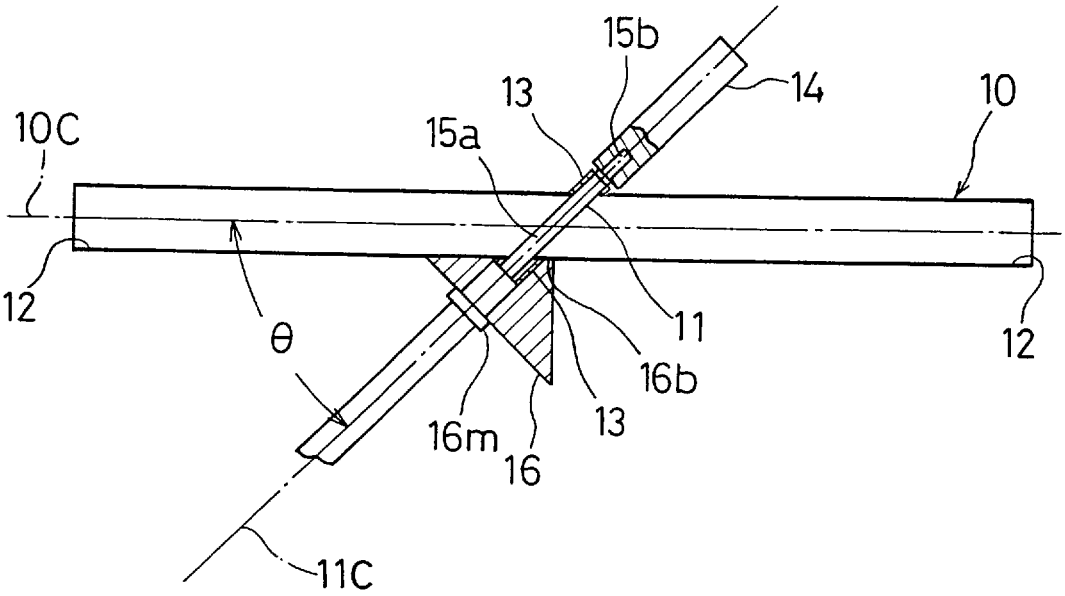
FIG. 6 is a cross-sectional view illustrating the usage state of the pole.

The first embodiment of the present invention will be described with reference to FIG. 1 through FIG. 12.

The lateral reflector plate 1 and longitudinal reflector plate 20 and bottom reflector plate 40 are brought into mutual orthogonal intersection, thus forming eight quarter-circle corner reflectors A of the same shape.

The longitudinal reflector plate 20 is of a stainless-steel plate, with the diameter thereof being, e.g., 440 mm. This longitudinal reflector plate 20 is formed of two half-circle shaped half plates 22 and 23 which are opposed across a rotation supporting shaft 10, and provided to both edges of the diameter 20*a* of these plates 22 and 23 are retaining means, e.g., retaining claws 5.

The lateral reflector plate 1 is of a stainless-steel plate, with the diameter thereof being, e.g., 440 mm. This lateral reflector plate 1 is formed of two half-circle shaped half plates 2 and 3 which are opposed across the rotation supporting shaft 10, and provided to both edges of the diameter la of these plates 2 and 3 are retaining means, e.g., retaining claws 5.

The half plates 2 and 3 of the lateral reflector plate 1 are of the same shape as the half plates 22 and 23 of the longitudinal reflector plate 20.

The bottom reflector plate 40 is comprised of four stainless-steel quarter plates 41, 42, 43, and 44, each being quarter-circles. Three of the four quarter plates, 41 through 43 are each formed of a pair of pieces 40P, each pieces being an eighth of a circle, with the apex of each quarter plate being formed to be 90°.

The pairs of pieces 40P are rotatably linked by folding portions 45 formed in the radius direction, with hinges 45*a* being used for the folding portion 45.

As to the three quarter plates 41 through 43, the side edges thereof are each linked to the half plates 2, 3, 22, and 23 by hinges 45*b*.

The quarter plate 44 is linked at one edge 44*x* to the half plate 23 by means of the hinges 45*b*, and provided to the other edge 44*y* is linking means, for example, a pin hole 44*a* is provided which is retained to a receiving member 48 by means of a pin 49. This retaining member 48 is fixed to the half plate 2, and is provided with a quarter plate insertion groove 48*a* and a through hole 48*b*. The rotation supporting shaft 10 is of a hollow cylindrical form, with an inclination supporting hole 11 provided in the center thereof for inserting of a pole thereto, rotating portions 12 being provided on both sides thereof for rotatably supporting the retaining claws 5.

The center axis 11C of this inclination supporting hole 11 is of a detection design angle θ as to the center axis 10C of the rotation supporting shaft 10. This detection design angle θ will be described in detail later.

Cylindrical seats 13 are fixed at an entrance and exit of this inclination supporting hole 11.

The tip portion 15A of the pole 15 is movably fit to this inclination supporting hole 11. This tip portion 15A is formed so as to be smaller in diameter than the main body portion 15B of the pole 15, with a threaded portion 15*b* for screwing a retaining nut 14 onto being provided on the tip of the insertion portion 15*a*, and with a receiving portion 16*m* being provided to the rear end portion thereof, this receiving portion 16*m* supporting an inclination fixing block.

The center axis of the insertion hole 16*a* of the inclination fixing block 16 is positioned on the center axis 11C of the inclination supporting hole 11. This inclination fixing block 16 is provided with a receiving portion 16*b* on the upper surface thereof.

This receiving portion 16*b* is formed so as to have an arc-shaped cross-sectional form corresponding with the outer circumference of the rotation supporting shaft 10, and when the pole 15 is inserted into the inclination supporting hole 11, contact is made with the outer circumference of the rotation supporting shaft 10, and is fixed. Accordingly, it is ensured that the center axis 10C and 11C continue to intersect at the detection design angle θ. The lower end of this block 16 is rotatably supported by the pole receiving portion 16*m*.

The main body 15B of the pole 15 is comprised of a first pole 15*e* and a second pole 15*f* linked by a folding portion 15C. The poles 15*e* and 15*f* are comprised of a storage portion 15*h* and an extending portion 15*k*.

The length 15L of the poles 15*e* and 15*f* when retracted is selected appropriately according to need, but the length 15L is made to be 500 mm, and the length of each of the poles 15*e* and 15*f* when the extending portion 15*k* is extended is made to be 2500 mm.

The folding portion 15C is provided with an arm 15*n* which is axially fixed to the end portions of both poles 15*e* and 15*f*, and a stopper 15*m*. This stopper 15*m* is a cylindrical member slidably fit to the end portions of the poles 15*e* and 15*f*, and restricts folding of the pole by means of sliding to change position.

The storing portion 15*h* of the second pole 15*f* is inserted into the holder 17. This holder 17 is formed to have a diameter slightly larger than that of the pole 15, and the length thereof is made to be, e.g., 500 mm. A fixing metal fitting 19 is provided to the lower end 17*b* of this holder 17. This fixing metal fitting 19 is provided with upper and lower pressing plates 19*a* and 19*b* for pinching a horizontal railing 18, and bolts 19*c* for linking the pressing plates 19*a* and 19*b*, with the pressing plates 19*b* being tightened by means of rotating nuts 19*d* provided to the bolts 19*c* in a certain direction, thus conducting fixing to the railing 18.

Next, description will be made regarding the detection design angle θ.

This angle θ is the angle at which the reflection angle of the bottom reflector plate 40 of the reflector R becomes maximum when the tip portion 15A of the pole 15 is inserted into the inclination supporting hole 11 and the pole 15 is in a longitudinal state, i.e., when the center axis 11C of the inclination supporting hole 11 is vertical.

Figure 9:
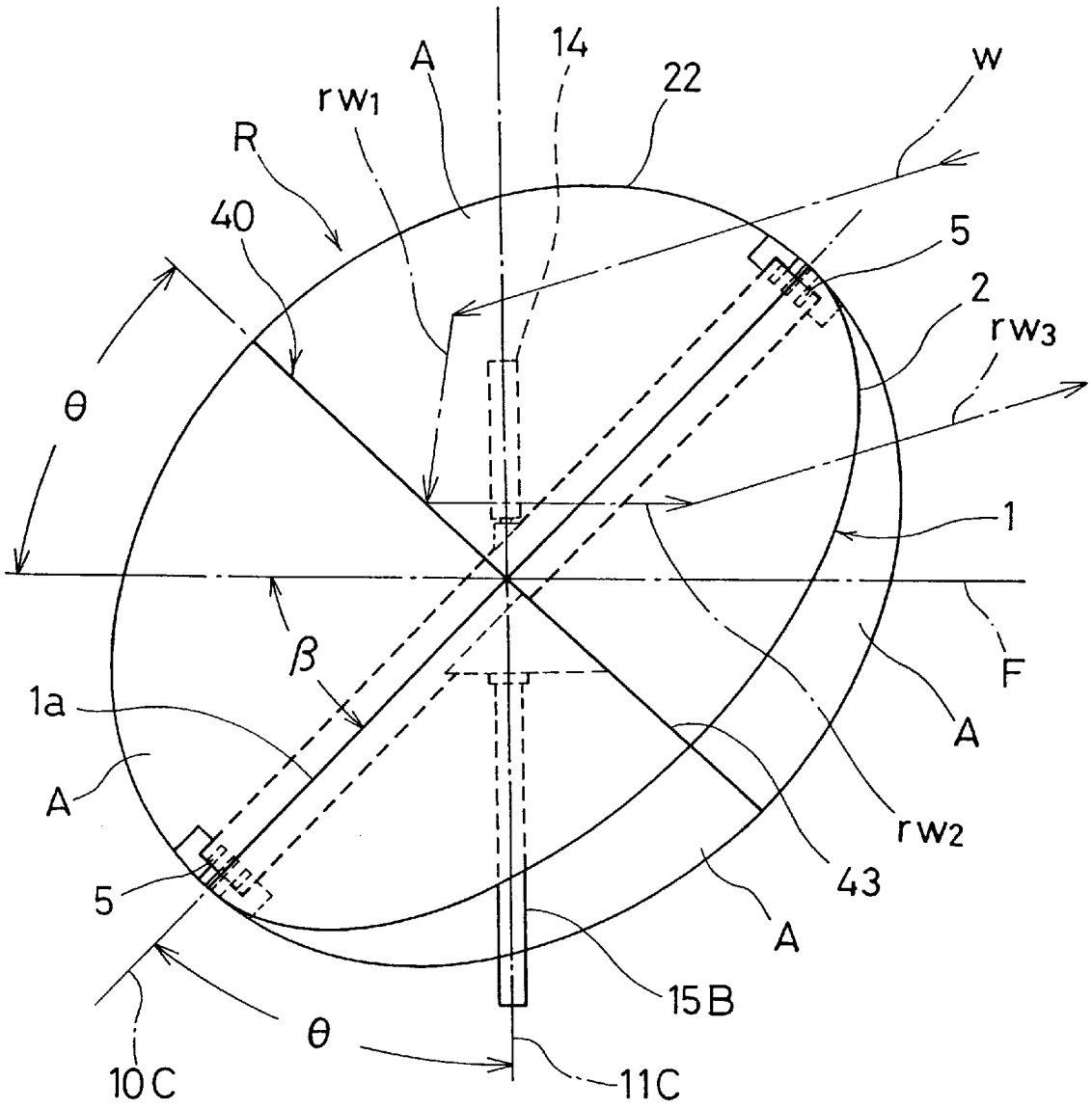
FIG. 9 is a perspective view illustrating the usage state of the handy reflector.
Figure 10:
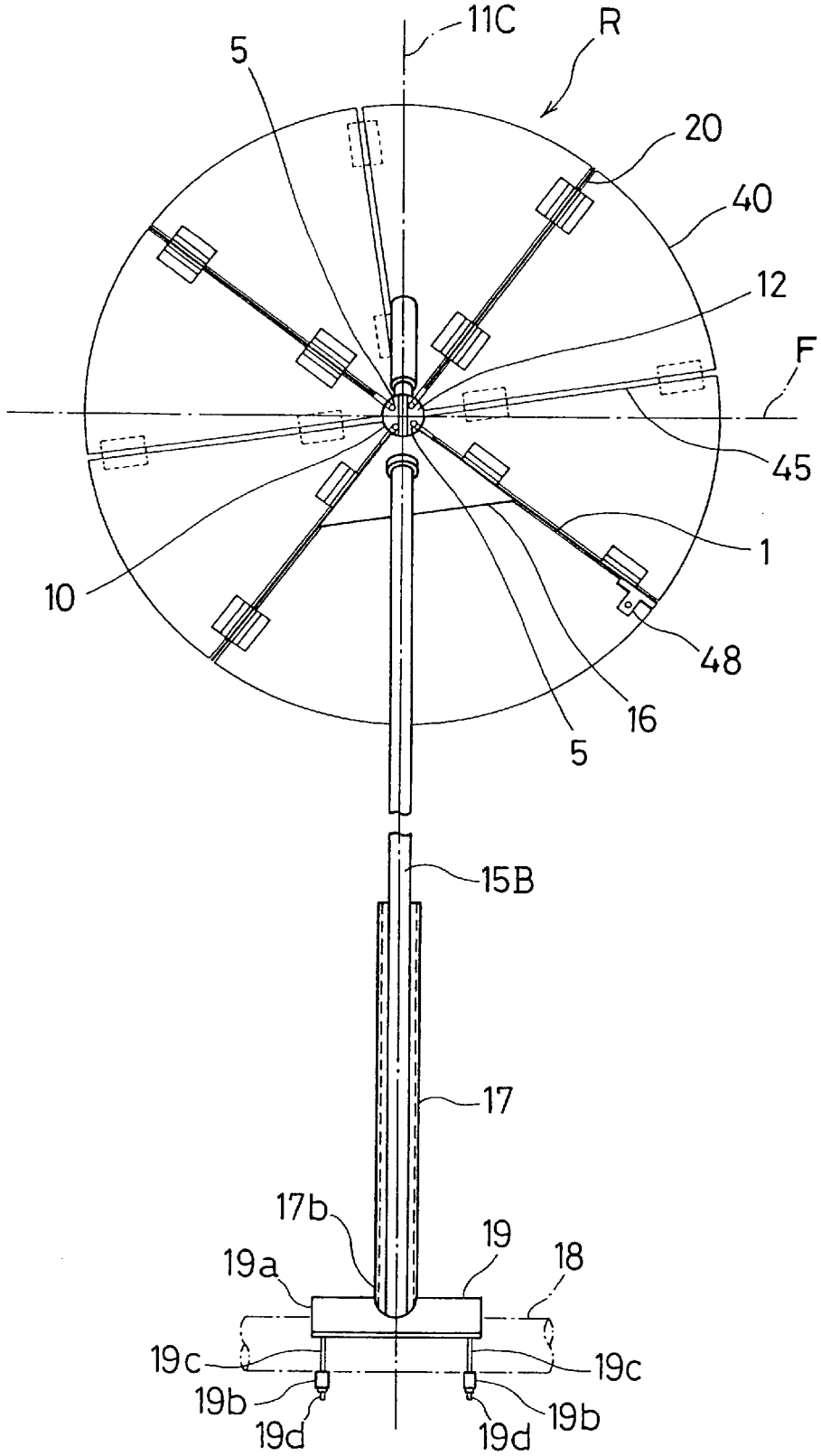
FIG. 10 is a side view illustrating the usage state of the handy reflector.
Figure 11:
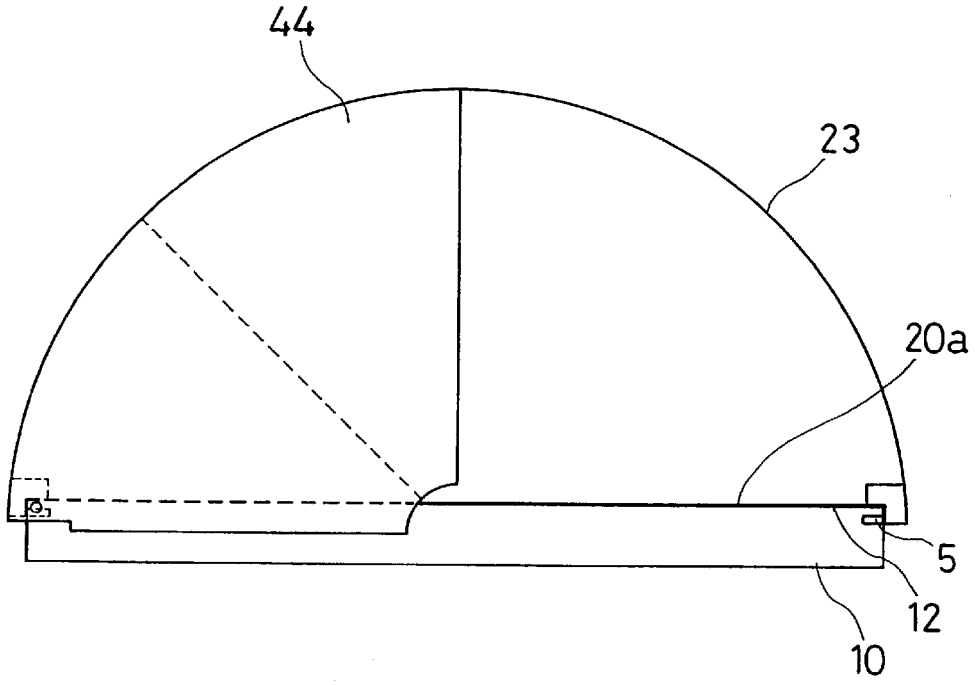
FIG. 11 is a plan view illustrating the folded state of the handy reflector.

As shown in FIG. 9, with an all-directional corner reflector A, the angle of intersection of the center axis 11C and the horizon F is $\beta+\theta=90°$ and also, the angle of intersection of the quarter plate 43 of the bottom reflector plate 40 and the horizon F is $\beta+\theta=90°$.

Accordingly, the detection design angle θ is the same angle θ as the angle of intersection between the center axis 10C of the rotation supporting shaft 10 and the center axis 11*c* of the inclination supporting hole 11, and thus it can be understood that the angle of the bottom reflector plate 40 becomes the detection design angle θ in an arrangement wherein the center axis 11C of the inclination supporting hole 11 intersects the center axis 10C at the angle θ. This angle θ is appropriately selected according to the type of the all-directional corner reflector, e.g., the angle θ=36° is selected for isosceles triangle corner reflectors, and the angle θ=35° for square corner reflectors.

Next, the operation of this embodiment will be described. First, description will be made regarding the case of setting the handy reflector which has been folded and stored.

The holder 17 is fixed to a horizontal railing 18 beforehand, by means of the fixing metal fitting 19.

The reflector is carried from a storage location to the position of the holder 17, and at the same time, the half plate 2 of the lateral reflector plate 1 and the half plate 23 of the longitudinal reflector plate 20 are held and the half plate 23 is rotated in a direction so as to be removed from the half plate 2, causing the half plate 23 to move while pulling the quarter plates 41 through 43, so that the lateral reflector plate 1 and the longitudinal reflector plate 20 each becomes a circular flat plate, and so that both plates 1 and 20 enter a state of orthogonal intersection through the rotation supporting shaft 10. At this time, the quarter plates 41, 42, and 43 become flat plate quarter plates with an apex angle α of 90° that cannot be stretched any further, so the half plate 23 cannot be rotated any further.

In this state, the side edge 44*y* of the quarter plate 44 is inserted into the insertion groove 48*a* of the receiving member 48, and the pin 49 is inserted into the through hole 48*b* and the pin hole 44*a* to fix the quarter plate 44. Thus, eight quarter-circle corner reflectors A are formed, forming an all-directional corner reflector R.

The insertion portion 15*a* of the tip of the pole 15 is fit to the inclination supporting hole 11 of the rotation supporting shaft 10, and brought into contact with the receiving portion 16*b* of the inclination fixing block 16, and at the same time a retaining nut 14 is screwed to the threaded portion 15*b* of the pole 15.

Subsequently, the storage portion 15*h* of the second pole 15*f* is inserted into the holder 17.

Figure 7:
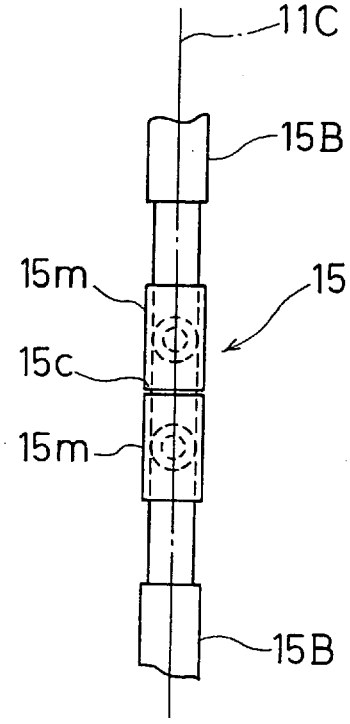
FIG. 7 is a frontal view illustrating the folded portion of the pole.
Figure 8:
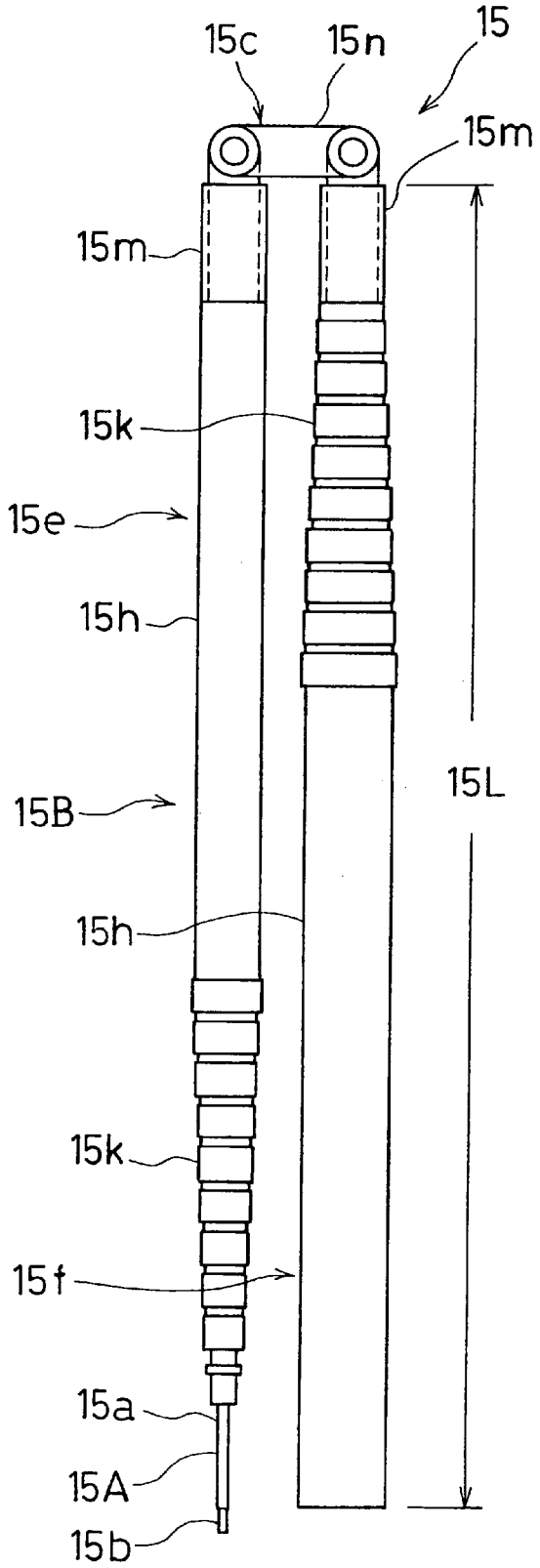
FIG. 8 is a frontal view illustrating the usage state of the pole when stored.

As shown in FIG. 7, the stoppers 15*m* of the folding portion 15C are slid so as to fix the arm 15*n* and the end portion of the pole, and at the same time the extending portion 15*k* of the pole 15 is extended, and when the length thereof reaches the predetermined length, e.g., 5000 mm, the all-directional reflector R is thereby situated in the predetermined position. Hence, the all-directional reflector R is rotatably provided at the predetermined position, while maintaining the detection design angle θ.

A radar wave W is emitted from an unshown radar, and as shown in FIG. 9, when there is incidence of the radar wave W to the quarter-circle corner reflector A of the all-directional corner reflector R, the radar wave W collides with one of the three orthogonal reflector plates, i.e., the half plates 2, 22, or quarter plate 43, e.g., with the reflector surface of the half plate 22 of the longitudinal reflector plate 20, and becomes the first reflected wave rw1.

This first reflected wave rw1 further collides with the reflector surface of the quarter plate 43 and reflects, and becomes the second reflected wave rw2. This second reflected wave rw2 collides with the reflector surface of the half plate 2 and reflects, and becomes the third reflected wave rw3, this third reflected wave rw3 being reflected to the direction of incidence of radar wave.

Hence, the radar wave W is reflected thrice, returns to the direction of incidence of the radar wave W, and is caught by means of radar.

Next, in the event of storing the reflector R of which use has been completed, the aforementioned is reversed, i.e., the extending portion 15*k* of the pole 15 is returned to the original length, the retaining nut 14 is removed and the leading portion 15A of the pole 15 is removed from the inclination supporting hole 11 of the rotation supporting shaft 10, and at the same time, the stoppers 15*m* are slid and the pole 15 is folded in half.

Figure 12:
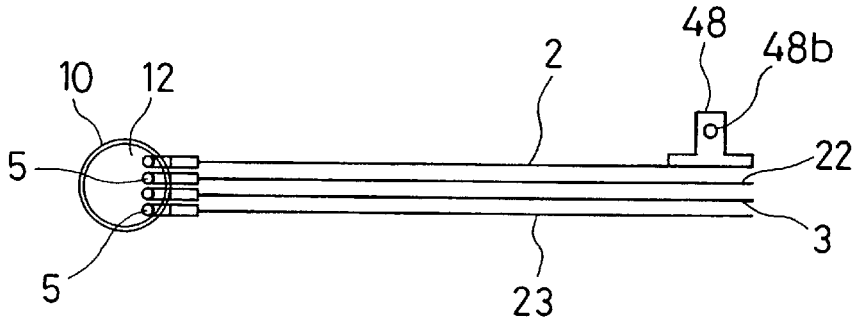
FIG. 12 is a side view illustrating the folded state of the handy reflector.

Next, the pin 49 is removed and the quarter plate 44 is removed from the receiving member 48, and the half plates 2, 22, and 23 are rotated around the rotation shaft 11, causing the half plates 2, 22, and 23 to move in the direction of approaching the half plate 3 while compressing the quarter plates 41 through 43. At this time, the quarter plates 41 through 43 are folded from the hinges 45*a* of the folding portions 45, so that the all-directional corner reflector R is stacked upon the half plate 2, and as shown in the plan view of FIG. 11 and the side view of FIG. 12, is reduced in size.

The folded reflector and the pole 15 which has been collapsed back to the original length are placed in an unshown storage case and stored.

Figure 13:
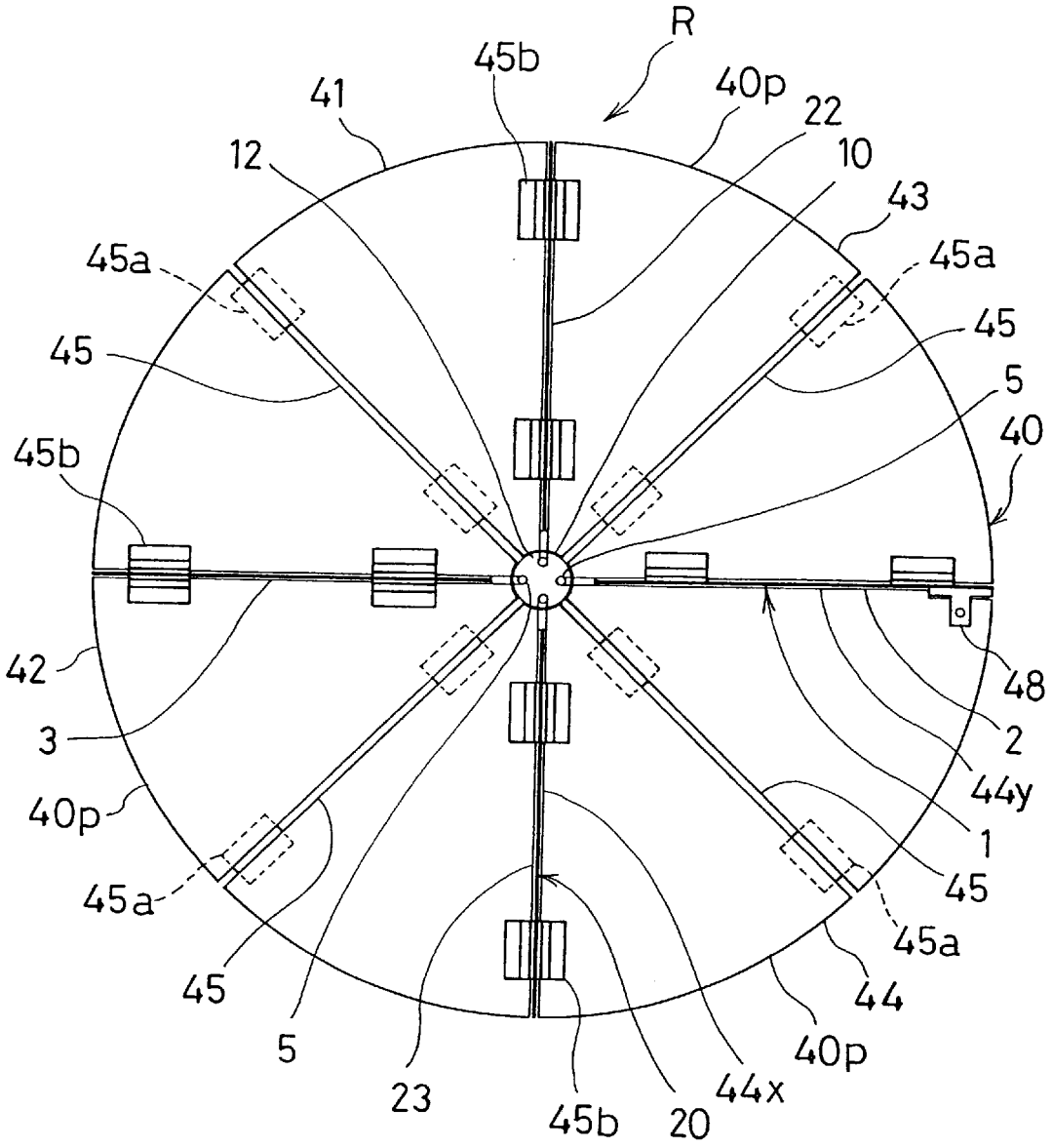
FIG. 13 is a side view illustrating the second embodiment of the present invention, and which corresponds with FIG. 2.
Figure 14:
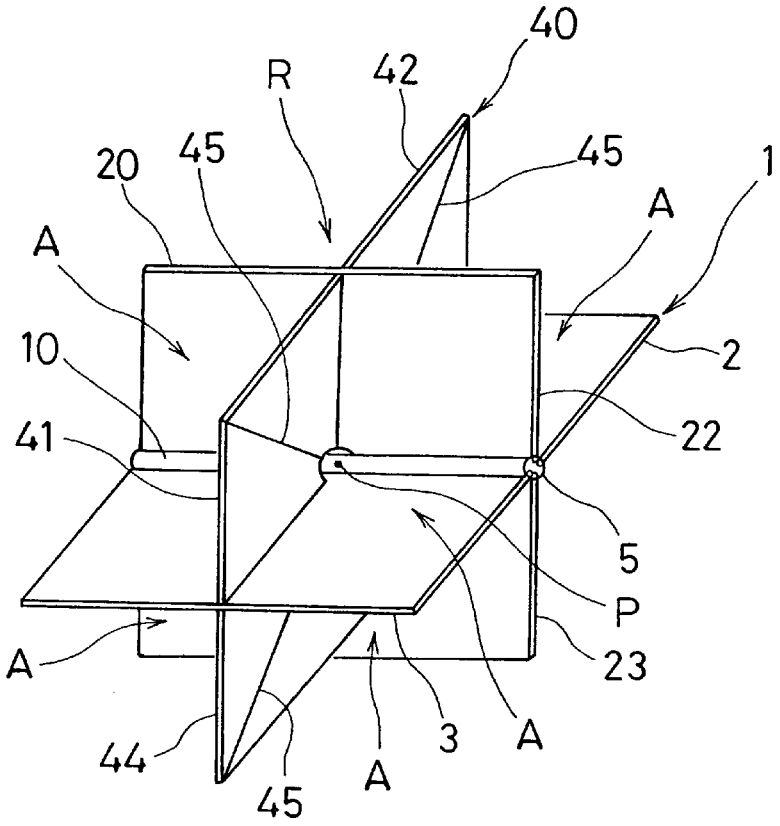
FIG. 14 is a perspective view illustrating the third embodiment of the present invention.
Figure 15:
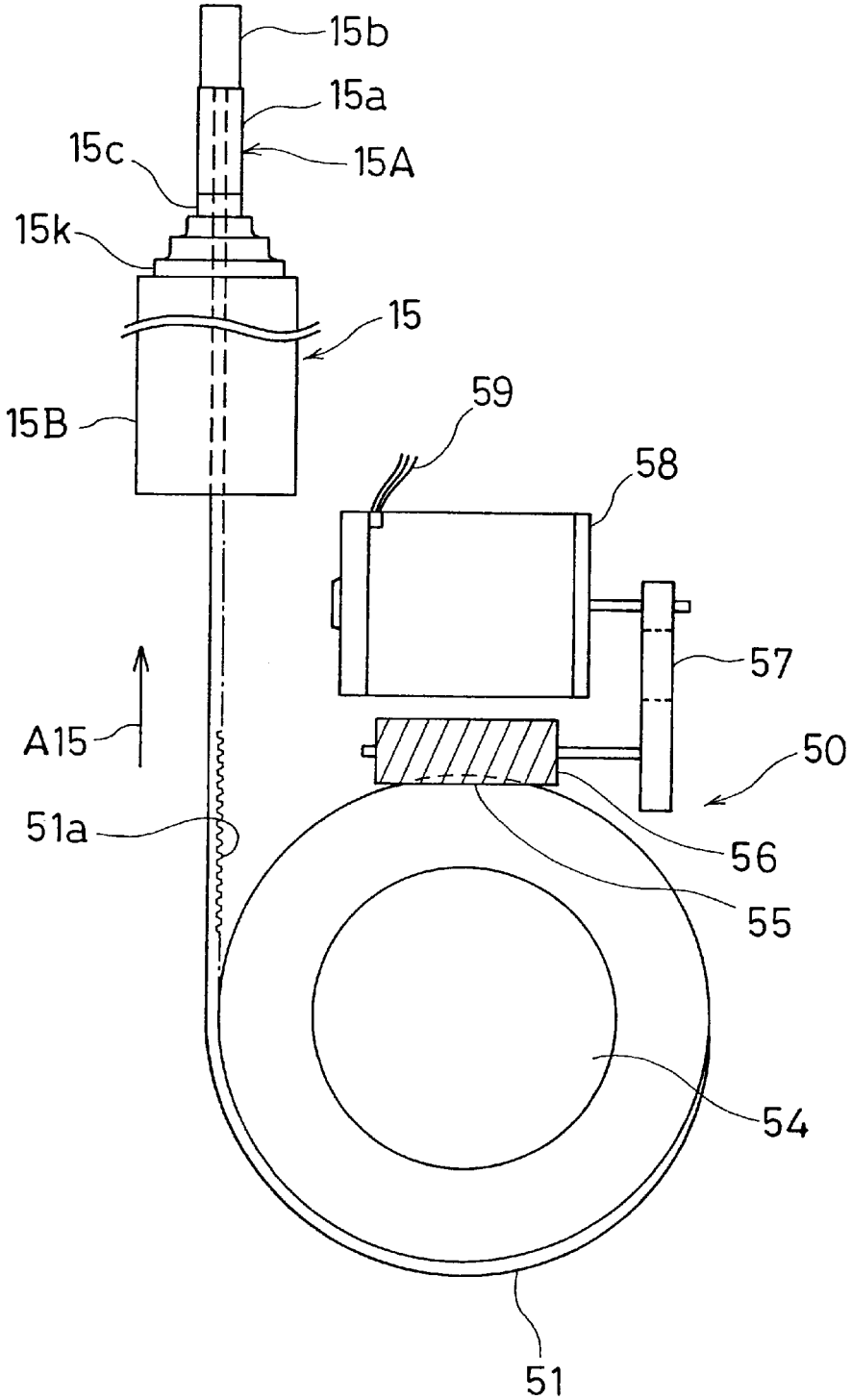
FIG. 15 is a frontal view illustrating an automatic extending device for the pole.
Figure 16:
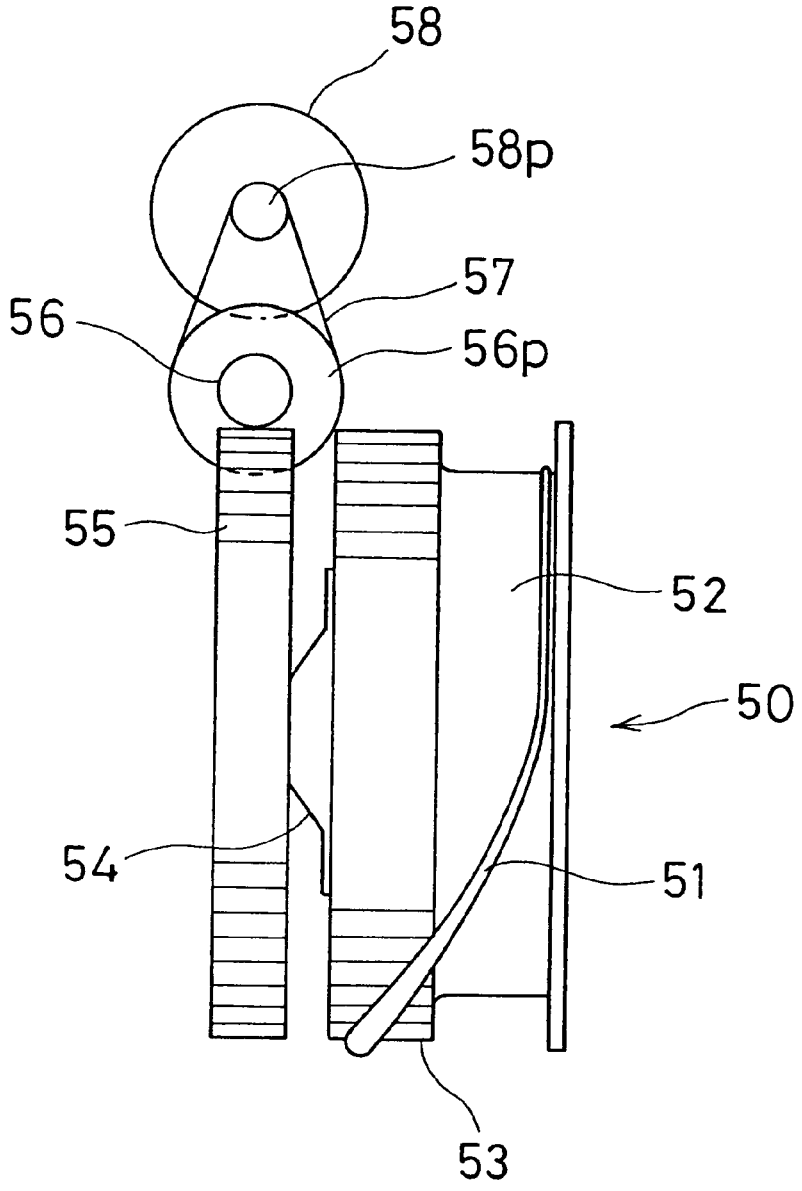
FIG. 16 is a side view illustrating the automatic extending device for the pole.
Figure 17:
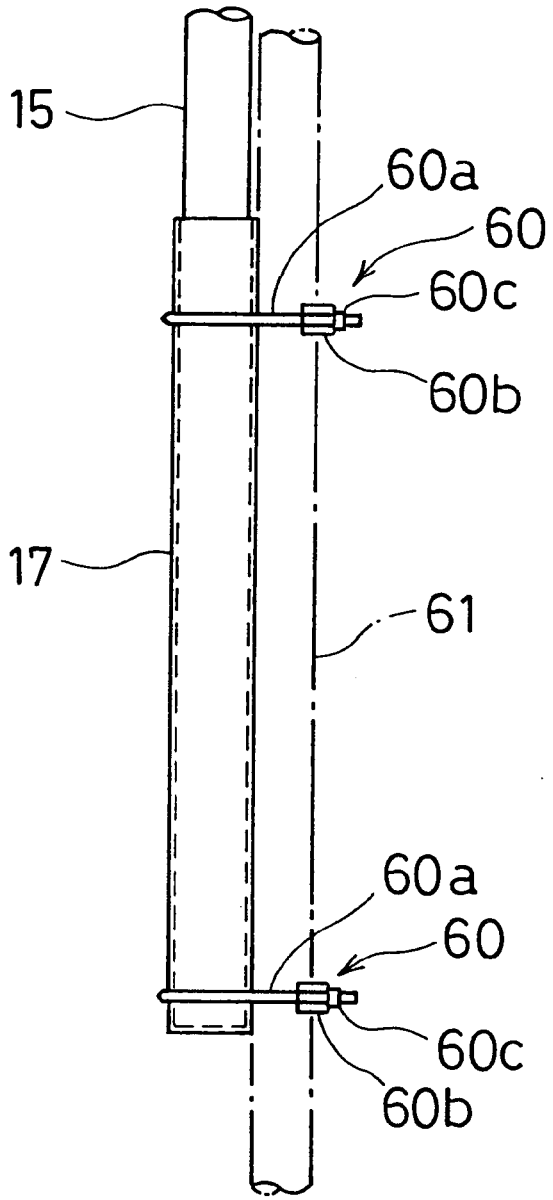
FIG. 17 is a frontal view illustrating the usage-state of the holder.

The second embodiment of the present invention will be described with reference to FIG. 13, with the reference numerals in the figures common to FIG. 1 through FIG. 12 of the first embodiment denoting the same name and the same function.

The differences between the present embodiment and the first embodiment are as follows:

(1) That a folded portion is provided to the quarter plate 44. Accordingly, when folding the all-directional corner reflector R, this quarter plate 44 is folded in the state of an eighth of a circle.

(2) That the pole 15 is not foldable, i.e., that a folding portion is not provided thereto.

The third embodiment of the present invention will be described with reference to FIG. 14 through FIG. 17. The differences between the present embodiment and the second embodiment are as follows:

(1) That the lateral reflector plate 1, longitudinal reflector plate 20, and bottom reflector plate 40 are each squares, thus forming the reflector plates of each corner reflector A of squares.

(2) That an automatic extending device 50 is provided to the pole 15. This device 50 is fixed to the insertion portion 15*a* of the pole 15, comprising a wire 51 with teeth 51*a*, a wire feeding gear 53 provided with a storage portion 52 of the wire 51, a worm wheel 55 performing intermittence with the wire feeding gear 53 via a clutch 54, a worm 56 which engages the worm wheel 55, a pulley 58*p* of a motor 58 linked with a pulley 56*p* of the worm 56 via a belt 57, and lead wiring 59 for connecting the motor 58 to an unshown electric power source.

Regarding the motor 58, e.g., a 12V or 6V DC motor is used, and a chargeable battery is used as the electric power source thereof. A dedicated power source is used therefor, but the power source used for the vessel may be used, as well.

Rotating the motor 58 causes the worm 56 to rotate via the belt 57, thus rotating the worm wheel 55. At this time, operating the clutch 54 to link the worm wheel 55 and the wire feeding gear 53 causes the wire feeding gear 53 which meshes with the teeth 51*a* on the inside of the wire 51 to rotate, pressing the wire 51 upwards in the direction of the arrow A15. Thus, the insertion portion 15*a* of the pole extends in the direction of the arrow A15, so that the extending portion 15*c* is also displaced in the same direction. When the pole 15 reaches the predetermined length, the clutch 54 is disengaged, and the motor 58 is stopped.

When returning the pole 15 to the original length, the motor 58 is rotated in a direction reverse to the aforementioned direction. This causes the wire 51 to move in the opposite direction as the arrow A15, and the wire is wound to the storage portion 52 of the wire feeding gear 53.

(3) That the holder 17 is fixed to a vertical railing 61 via fixing metal fittings 60. The fixing metal fitting 60 is comprised of a U-shaped bolt 60*a*, a pressing plate 60*b* fit to both ends of the bolt 60*a*, and nuts 60*c* for tightening the pressing plate 60*b*. The holder 17 may be fixed to the vertical railing 61 beforehand, but in the event that it is an obstacle, it may be fixed to the railing 61 using the fixing metal fittings 60 when using the reflector.

Figure 18:
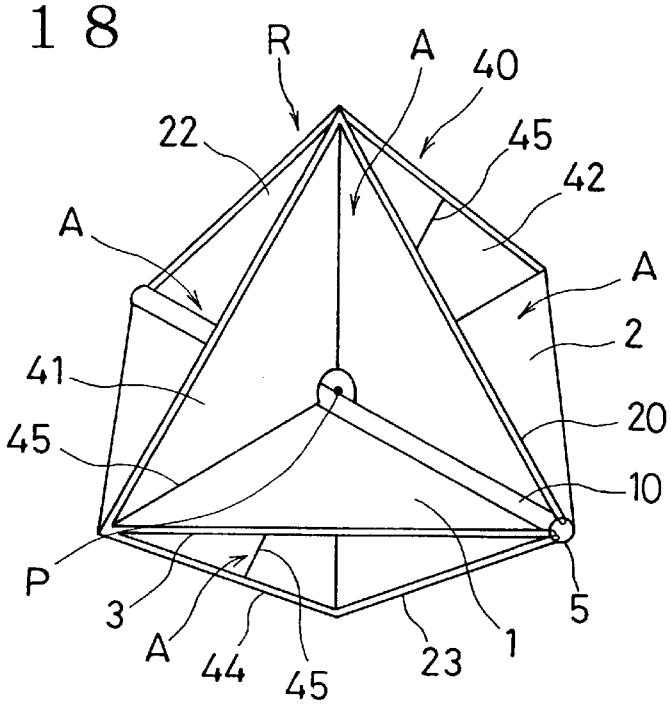
FIG. 18 is a perspective view illustrating the fourth embodiment of the present invention, and is a perspective view of a reflector provided with isosceles triangle corner reflectors.
Figure 19:
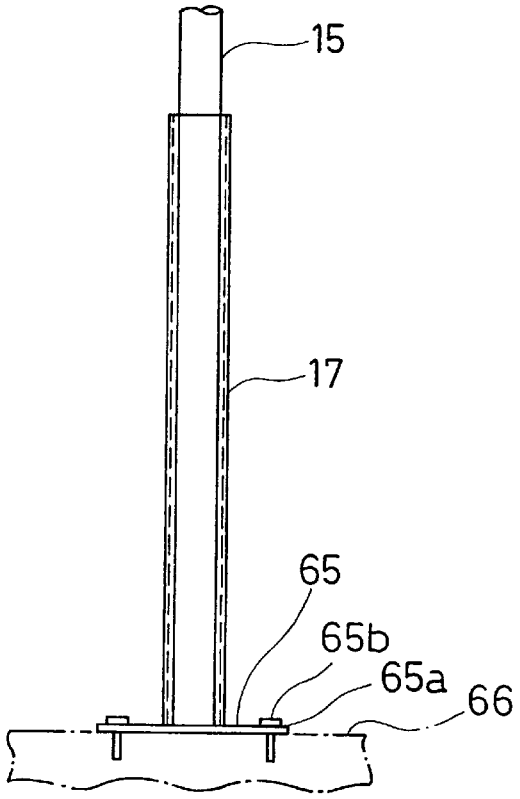
FIG. 19 is a drawing illustrating the state of attachment of the pole.

The fourth embodiment of the present invention will be described with reference to FIG. 18 and FIG. 19, with the reference numerals in the figures common to FIG. 1 through FIG. 12 of the first embodiment denoting the same name and the same function.

The differences between this fourth embodiment and the third embodiment are as follows:

(1) That the lateral reflector plate 1, longitudinal reflector plate 20, and bottom reflector plate 40 are each quadrangles, and the lateral reflector plate 1, longitudinal reflector plate 20, and bottom reflector plate 40 are each positioned such that the diagonal lines thereof orthogonally intersect at the center point P. As shown in the Figure, the reflector plates of each corner reflector A take the form of isosceles triangles.

(2) That the holder 17 is fixed to a horizontal surface 66 via a fixing metal fitting 65. This fixing metal fitting 65 is comprised of a flange portion 65*a* on the bottom end of the holder 17, and bolts 65*b* for securing the flange portion 65*a* to the horizontal surface 66.

Figure 20:
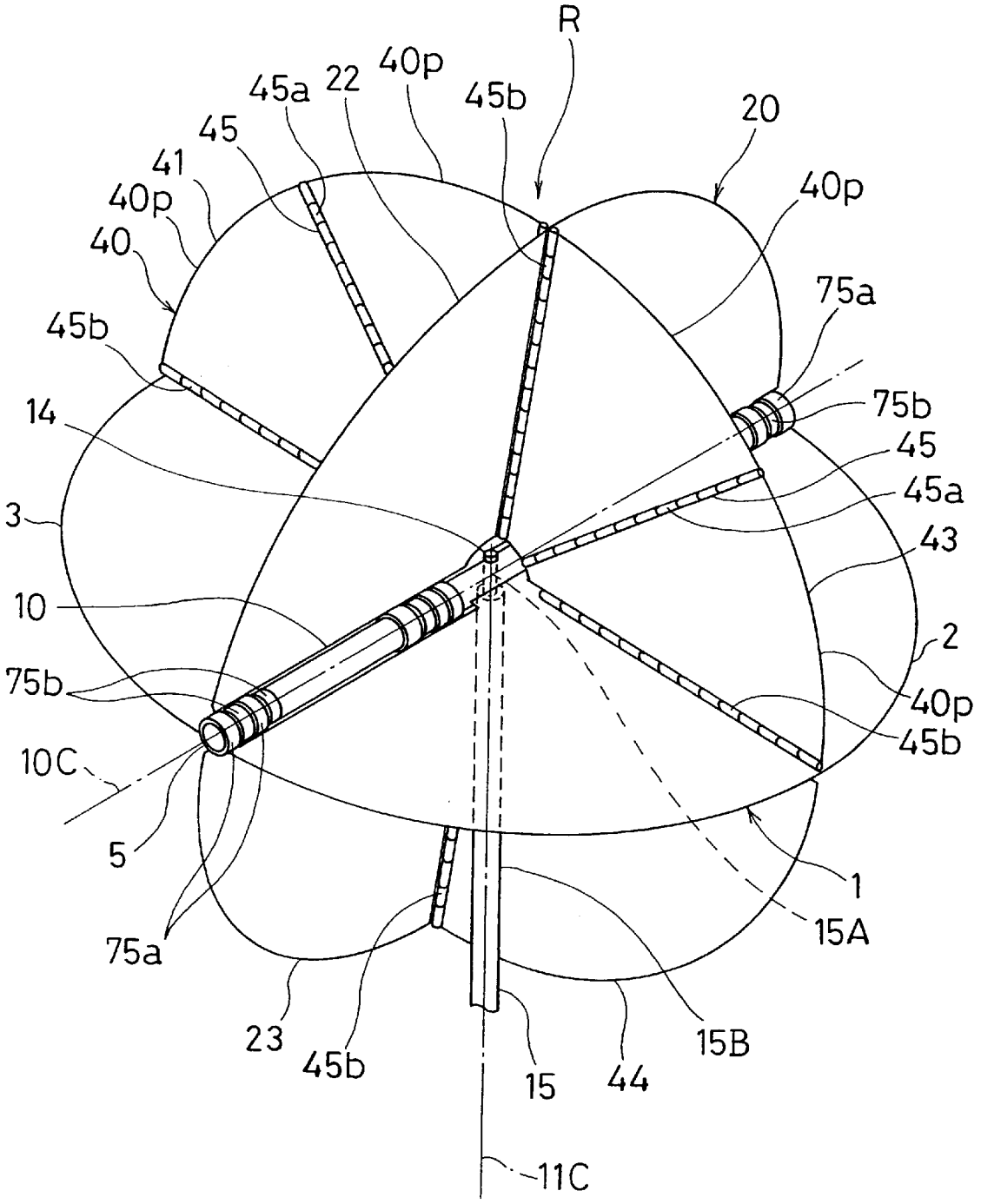
FIG. 20 is a perspective view illustrating the fifth embodiment of the present invention.
Figure 21:
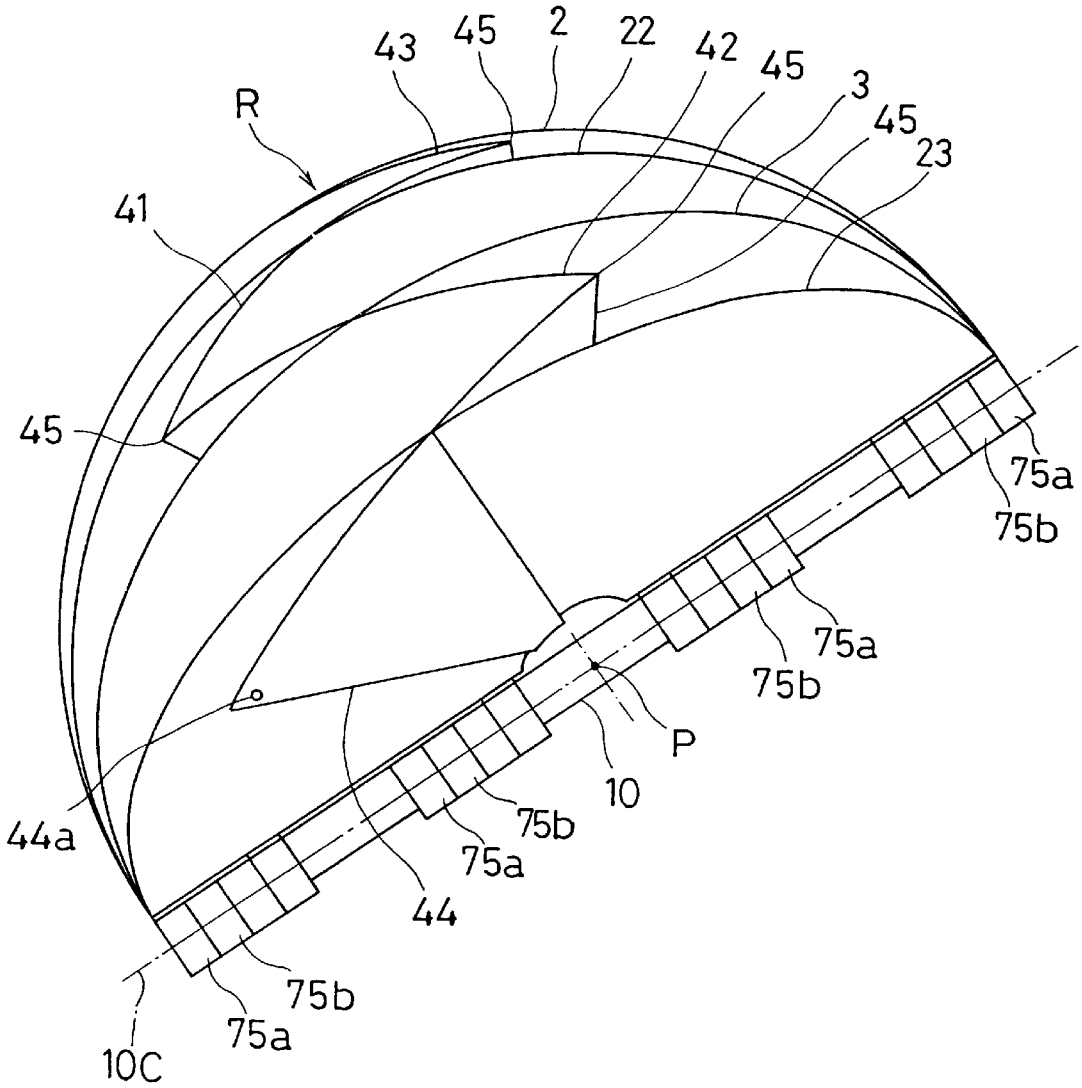
FIG. 21 is a perspective view illustrating the folded state of the handy reflector.

The fifth embodiment of the present invention will be described with reference to FIG. 20 and FIG. 21, with the reference numerals in the figures common to FIG. 1 through FIG. 12 of the first embodiment denoting the same name and the same function.

The differences between the present embodiment and the first embodiment are as follows:

(1) That the half plates 2, 3, 22, and 23 of the lateral reflector plate 1 and the longitudinal reflector plate 20 are rotatably linked to the rotation supporting shaft 10 with hinges 75*a* and 75*b*.

The present invention is constructed as described above, and allows for a folded handy reflector to be opened with a single action to form an all-directional corner reflector, which can be precisely set at the detection design angle.

Accordingly, radar waves can be caught and reflected more effectively over a wider area than that of prior art, thereby providing an all-directional corner reflector with excellent capabilities.

The sixth embodiment of the present invention will be described. The differences between the present embodiment and the first embodiment are as follows:

(1) That each of the reflector plates 1, 20, and 40 are formed of synthetic resin or aluminum, instead of being formed of stainless-steel.

(2) That the pole is formed of synthetic resin, carbon, glass fiber, or aluminum, instead of being formed of stainless-steel.

Industrial Applicability

The present invention is a reflector which is foldable and handy for carrying, and is used for marine vessels, particularly small marine vessels, FRP pleasure boats, and the like.

What is claimed is:

1. A foldable handy reflector, comprising:

a lateral reflector plate having two rotatable half plates mutually opposed through a rotation supporting shaft introduced therebetween, a longitudinal reflector plate having two half plates mutually opposed through said rotation supporting shaft introduced therebetween, wherein said lateral reflector plate and longitudinal reflector plate are vertical to each other, a foldable bottom reflector plate having four quarter plates, wherein each of said quarter plates intersected orthogonally with said lateral reflector plate and longitudinal plate, and said rotation supporting shaft further comprising an inclination supporting hole with an inclination of a detection design angle as to the center axis of said rotation supporting shaft.

2. A foldable handy reflector according to claim 1, wherein the two half plates are mutually linked by hinges.

3. A foldable handy reflector according to claim 1, wherein the half plates of said lateral reflector plate and said longitudinal reflector plate further comprise claws on both diameter-wise edges thereof, said claws being engaged with both edges of said rotation supporting shaft.

4. A foldable handy reflector according to claim 1, wherein three of the four quarter plates of the bottom reflector plate further comprising: folding portions, and both side edges of the three quarter plates being rotatably maintained to the adjacent half plate of the lateral reflector plate and longitudinal reflector plate, and the other quarter plate further comprising: one side edge thereof being rotatably maintained to the half plate of the adjacent lateral reflector plate or longitudinal reflector plate, and the other side edge thereof being detachably connected to the other adjacent half plate through a linking means.

5. A foldable handy reflector according to claim 1, wherein said inclination supporting hole further comprising seating portions at an entrance and exit thereof.

6. A foldable handy reflector, comprising:

a lateral reflector plate having two rotatable half plates mutually opposed through a rotation supporting shaft introduced therebetween, a longitudinal reflector plate having two half plates mutually opposed through said rotation supporting shaft introduced therebetween, wherein said lateral reflector plate and longitudinal reflector plate are vertical to each other, a foldable bottom reflector plate having four quarter plates, and each of said quarter plates intersected orthogonally with said lateral reflector plate and longitudinal reflector plate, an inclination supporting hole formed in said rotation supporting shaft, at an inclination of a detection design angle as to the center of said rotation supporting shaft, and a hoisting supporting member inserted through said inclination supporting hole and rotatably supporting said rotation supporting shaft.

7. A foldable handy reflector according to claim 6 wherein said hoisting supporting means comprises a pole, and said pole further comprising:

a threaded portion on the leading end of an insertion portion of said pole for engaging a retaining nut, and an inclination fixing block locating on the rear end of said insertion portion of said pole.

8. A foldable handy reflector according to claim 7: wherein said pole is extendible.

9. A foldable handy reflector according to claim 6, wherein the two half plates are mutually linked by hinges.

10. A foldable handy reflector according to claim 6, wherein the half plates of said lateral reflector plate and said longitudinal reflector plate further comprise claws on both diameter-wise edges thereof, said claws being engaged with both edges of said rotation supporting shaft.

11. A foldable handy reflector according to claim 6, wherein three of the four quarter plates of the bottom reflector plate further comprising: folding portions, and both side edges of the three quarter plates being rotatably maintained to the adjacent half plate of the lateral reflector plate and longitudinal reflector plate, and the other quarter plate further comprising: one side edge thereof being rotatably maintained to the half plate of the adjacent lateral reflector plate or longitudinal reflector plate, and the other side edge thereof being detachably connected to the other adjacent half plate through a linking means.

12. A foldable handy reflector according to claim 6, wherein said inclination supporting hole further comprising seating portions at an entrance and exit thereof.

* * * * *